US007165427B1

(12) United States Patent
Lai

(10) Patent No.: US 7,165,427 B1
(45) Date of Patent: Jan. 23, 2007

(54) LOCK DEVICE FOR A BOX

(76) Inventor: Yung-Tsai Lai, No. 13, Tung-Kuang 8th St., Pei Dist, Taichung City (TW)

( * ) Notice: Subject to any disclaimer, the term of this patent is extended or adjusted under 35 U.S.C. 154(b) by 0 days.

(21) Appl. No.: 11/219,670

(22) Filed: Sep. 7, 2005

(51) Int. Cl.
*B65D 55/02* (2006.01)

(52) U.S. Cl. ..... 70/159; 70/346; 70/404; 292/153; 292/240

(58) Field of Classification Search ..... 70/159–162, 70/53, 233, 379 R, 380, 79, 81, 70, 71, 346, 70/403–404, DIG. 13, DIG. 42; 292/153, 292/240, 304, DIG. 11, 140, DIG. 145; 220/210
See application file for complete search history.

(56) References Cited

U.S. PATENT DOCUMENTS

| | | | | | |
|---|---|---|---|---|---|
| 859,064 | A * | 7/1907 | Hitchens | 70/99 |
| 3,008,320 | A * | 11/1961 | Cheney | 70/74 |
| 3,350,902 | A * | 11/1967 | Chance | 70/74 |
| 4,085,600 | A * | 4/1978 | Bindari | 70/39 |
| 4,987,753 | A * | 1/1991 | Kuo | 70/39 |
| 5,406,812 | A * | 4/1995 | Jaw | 70/233 |
| 5,485,734 | A * | 1/1996 | Yang | 70/74 |
| 5,568,740 | A * | 10/1996 | Lin | 70/49 |
| 5,832,762 | A * | 11/1998 | McDaid | 70/455 |
| 6,026,664 | A * | 2/2000 | Lin | 70/49 |
| 6,116,663 | A * | 9/2000 | Robert | 292/153 |
| 6,152,499 | A * | 11/2000 | Robert | 292/153 |
| 6,457,336 | B1 * | 10/2002 | Bremicker | 70/233 |

* cited by examiner

*Primary Examiner*—Suzanne Dino Barrett
*Assistant Examiner*—Christopher Boswell
(74) *Attorney, Agent, or Firm*—Hunton & Williams

(57) ABSTRACT

A lock device for a box includes a locking shaft, a lock shell, a lock core, a limiting unit, and a key. The lock shell has a surrounding shell wall that confines a core-receiving space, and that is formed with an insert hole in spatial communication with the core-receiving space to permit removable extension of the locking shaft into the core-receiving space. The lock core is disposed movably in the core-receiving space, and has a surrounding core wall that confines a key compartment and that is formed with a shaft engaging unit. The lock core is rotatable in the lock shell between locking position and unlocking positions. The limiting unit limits rotation of the lock core in the lock shell. The key is inserted removably into the key compartment and is operable so as to drive rotation of the lock core between the locking and unlocking positions.

7 Claims, 7 Drawing Sheets

LOCK DEVICE FOR A BOX

BACKGROUND OF THE INVENTION

1. Field of the Invention

The invention relates to a lock device, more particularly to a lock device that is simple in structure and that can be applied to a box having thin walls with relative ease.

2. Description of the Related Art

It is usually difficult to install lock devices in small boxes, such as wine boxes, cigarette boxes, gift boxes, jewelry boxes, and music boxes, etc., due to their small sizes. For a box with walls of sufficient thickness for installing lock devices, the lock device that is installed is normally a rectangular lock device. Wood working machinery is used to mill and create a rectangular lock-receiving space in the wall of the box to receive the lock device therein. This process for installing the lock device is complex, difficult to implement, costly, and not applicable to boxes having thinner walls.

SUMMARY OF THE INVENTION

Therefore, the object of the present invention is to provide a lock device that is simple in structure and that can be applied to a box having thin walls with relative ease.

According to the present invention, there is provided a lock device for a box. The lock device includes a locking shaft, a lock shell, a lock core, a limiting unit, and a key.

The lock shell has a surrounding shell wall that surrounds a core axis and that confines a core-receiving space. The surrounding shell wall is formed with an insert hole that is disposed radially relative to the core axis, that is in spatial communication with the core-receiving space, and that permits removable extension of the locking shaft into the core-receiving space.

The lock core is disposed movably in the core-receiving space and has a surrounding core wall that surrounds the core axis, that confines a key compartment, and that is formed with a shaft engaging unit. The lock core is rotatable about the core axis in the lock shell between a locking position where the shaft engaging unit engages the locking shaft that is extended through the insert hole, and an unlocking position where the shaft engaging unit is disengaged from the locking shaft.

The limiting unit limits rotation of the lock core in the lock shell.

The key is inserted removably into the key compartment and is operable so as to drive rotation of the lock core about the core axis between the locking and unlocking positions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
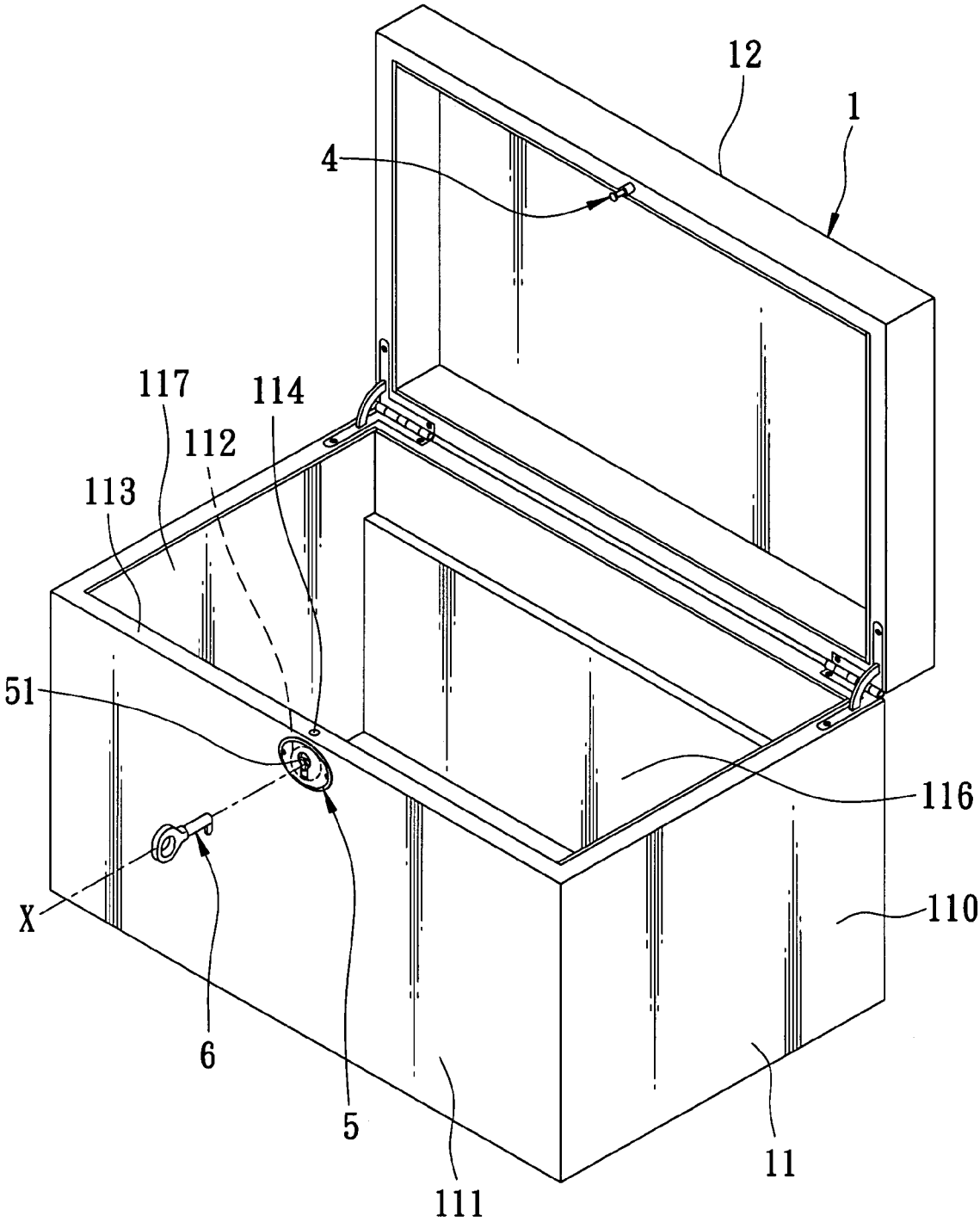
FIG. 1 is a perspective view of a box having the preferred embodiment of a lock device according to the present invention installed therein.
Figure 2:
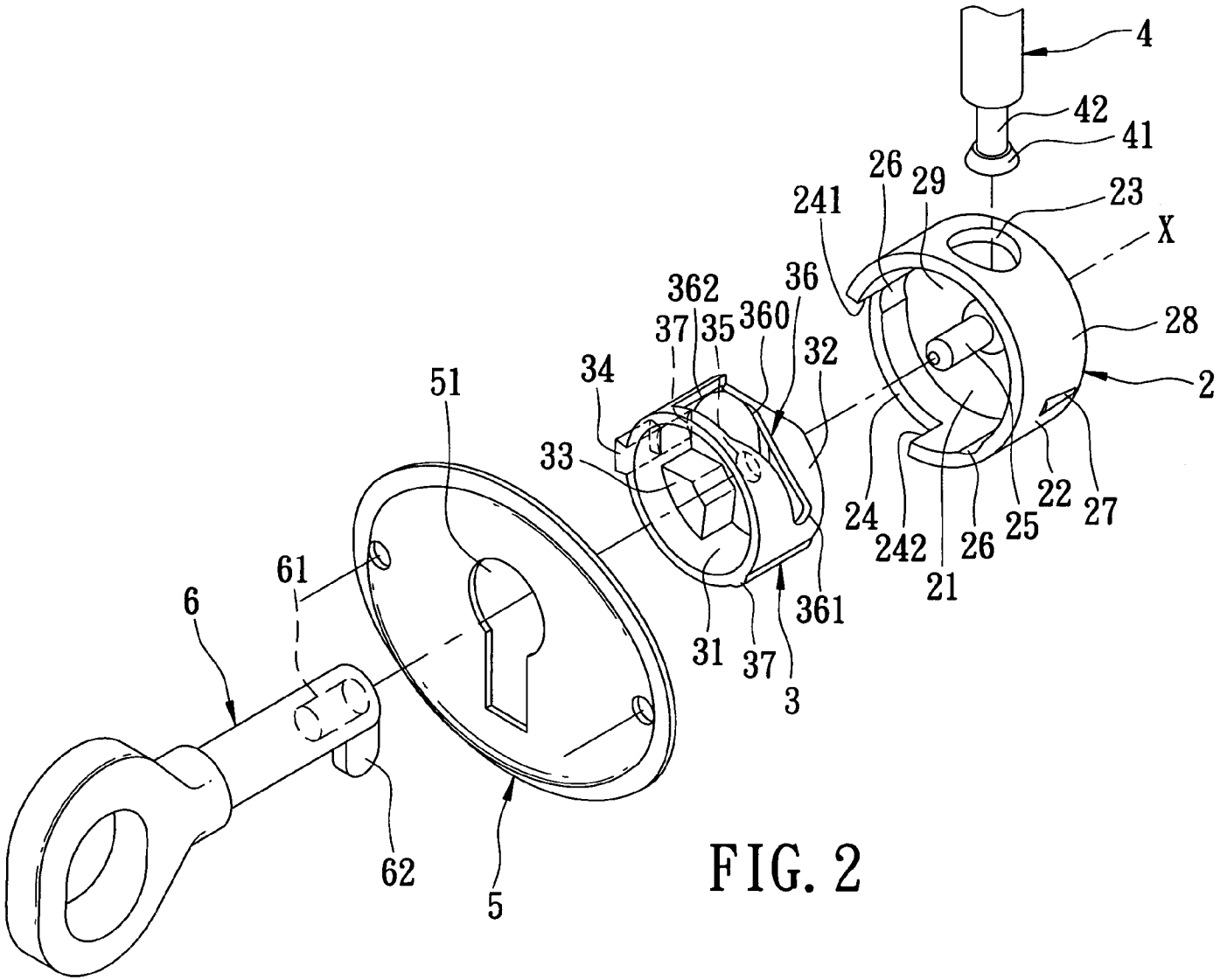
FIG. 2 is an exploded perspective view of the preferred embodiment.

As shown in FIG. 1 and FIG. 2, the preferred embodiment of a lock device for a box 1 according to the present invention includes a lock shell 2, a lock core 3, a locking shaft 4, a face plate 5, and a key 6. The box 1 has a body portion 11 and a lid portion 12. The body portion 11 has a surrounding box wall 110 that confines a box compartment 116 and that has an outer surface 111 formed with a lock-receiving space 112 extending along a core axis (X), and a top surface 113 confining a box opening 117 and formed with an extension hole 114 extending perpendicularly toward the lock-receiving space 112 and in spatial communication with the lock-receiving space 112. The lock-receiving space 112 is formed by drilling a hole or a recess in the outer surface 111 of the surrounding box wall 110. The lid portion 12 is coupled to the body portion 11 to cover and uncover the box opening 117.

The lock shell 2 is made by die casting or lathe-forming, and is installed in the lock-receiving space 112 of the body portion 11. The lock shell 2 has a surrounding shell wall 22 that surrounds the core axis (X) and that confines a core-receiving space 21, and a back wall 29 formed with a guide shaft 25 that extends along the core axis (X) into the core-receiving space 21. The surrounding shell wall 22 is formed with a notch 24 that extends in a circumferential direction relative to the core axis (X), two pits 26 that are in spatial communication with the core-receiving space 21 and that are angularly spaced apart from each other, and an insert hole 23 that is disposed radially relative to the core axis (X), and that is aligned with the core-receiving space 21. The insert hole 23 is in spatial communication with the extension hole 114 of the body portion 11 when the lock shell 2 is installed in the lock-receiving space 112. In this embodiment, the notch 24 has first and second notch edges 241, 242 that are approximately 100 degrees spaced apart from each other and that extend parallel to the core axis (X). The surrounding shell wall 22 has an outer wall surface 28 disposed away from the core-receiving space 21 and formed with two wedges 27 (only one is visible in FIG. 2) that extend parallel to the core axis (X), and that gradually increase in thickness in a direction away from the back wall 29. The wedges 27 are for securing the lock shell 2 immovably in the lock-receiving space 112 of the body portion 11.

The lock core 3 is disposed movably in the core-receiving space 21, and has a surrounding core wall 32 that surrounds the core axis (X), that confines a key compartment 31, and that is formed with a driven projection 33 extending into the key compartment 31, a stop block 34 extending into the notch 24 in the surrounding shell wall 22, a shaft engaging unit 36, and two resilient positioning bumps 37 capable of engaging the pits 26 in the surrounding shell wall 22. The stop block 34 cooperates with the notch 24 to form a limiting unit for limiting rotation of the lock core 3 in the lock shell 2. The lock core 3 is further formed with a guide hole 35 along the core axis (X) to permit extension of the guide shaft 25 into the key compartment 31.

The lock core 3 is rotatable about the core axis (X) in the lock shell 2 between a locking position (see FIGS. 4 and 5) where the shaft engaging unit 36 engages the locking shaft 4 that is extended through the insert hole 23, and an unlocking position (see FIGS. 6 and 7) where the shaft engaging unit 36 is disengaged from the locking shaft 4.

In this embodiment, the shaft engaging unit 36 is an engagement slot 360 that is formed in the surrounding core wall 32, that extends in a circumferential direction relative to the core axis (X), that is aligned with the insert hole 23 in a radial direction relative to the core axis (X), and that is in spatial communication with the key compartment 31. The engagement slot 360 has an engaging segment 361 and an inserting segment 362 in spatial communication with the engaging segment 361. The engagement slot 360 has a slot width that gradually increases from the engaging segment 361 to the inserting segment 362.

The locking shaft 4 is mounted to the lid portion 12 of the box 1 and is capable of removable extension into the key compartment 31 through the extension hole 114 in the body portion 11 of the box 1, the insert hole 23 in the surrounding shell wall 22, and the engagement slot 360 in the surrounding core wall 32. The locking shaft 4 has a restricted neck portion 42 and an enlarged head portion 41 connected to the restricted neck portion 42. The enlarged head portion 41 has a cross-section larger than the engaging segment 361 of the engagement slot 360 and the cross-section of the restricted neck portion 42, and smaller than the inserting segment 362 of the engagement slot 360.

Figure 4:
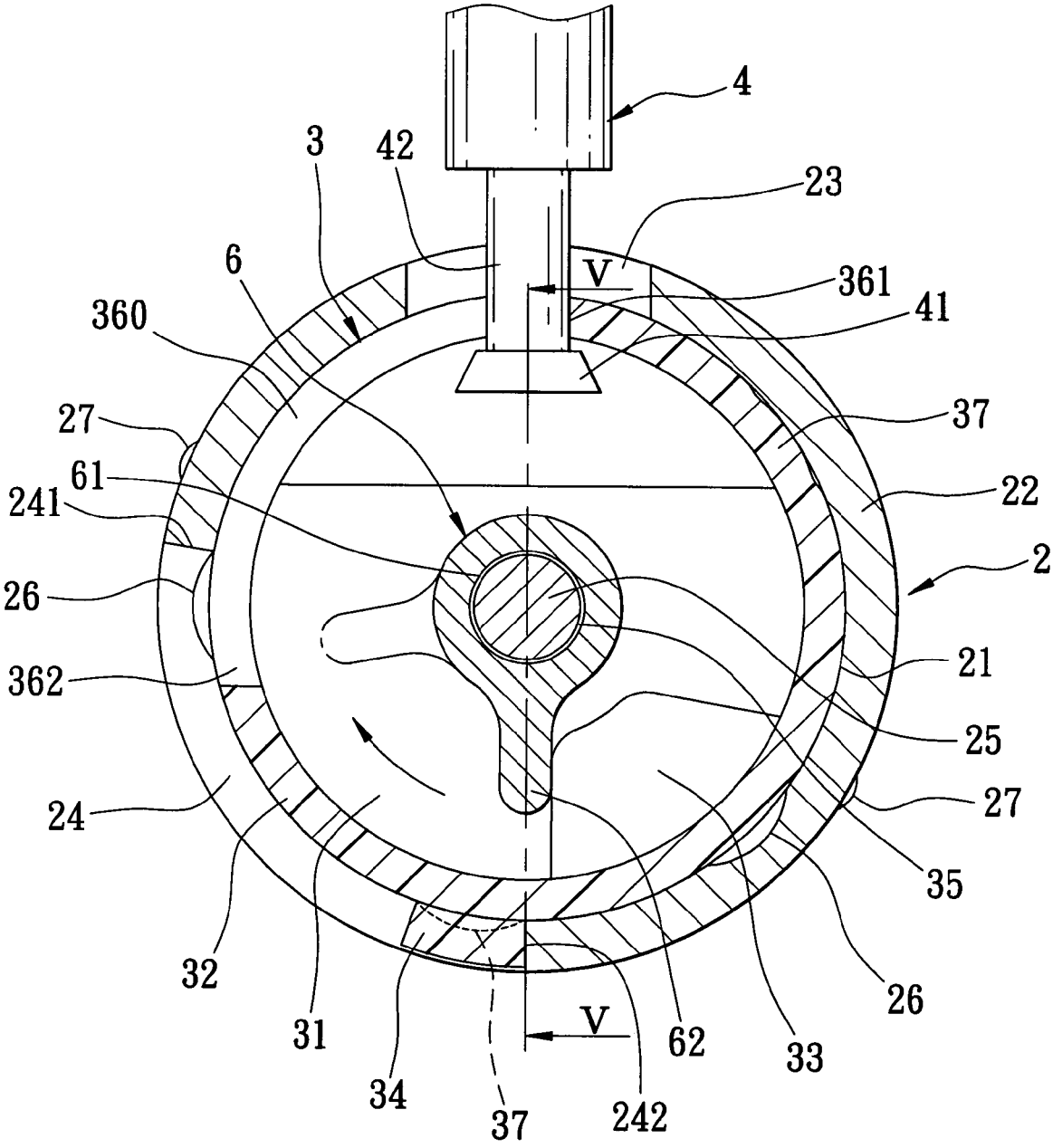
FIG. 4 is sectional view of the preferred embodiment in a direction transverse to a core axis, illustrating a lock core in a locking position.
Figure 6:
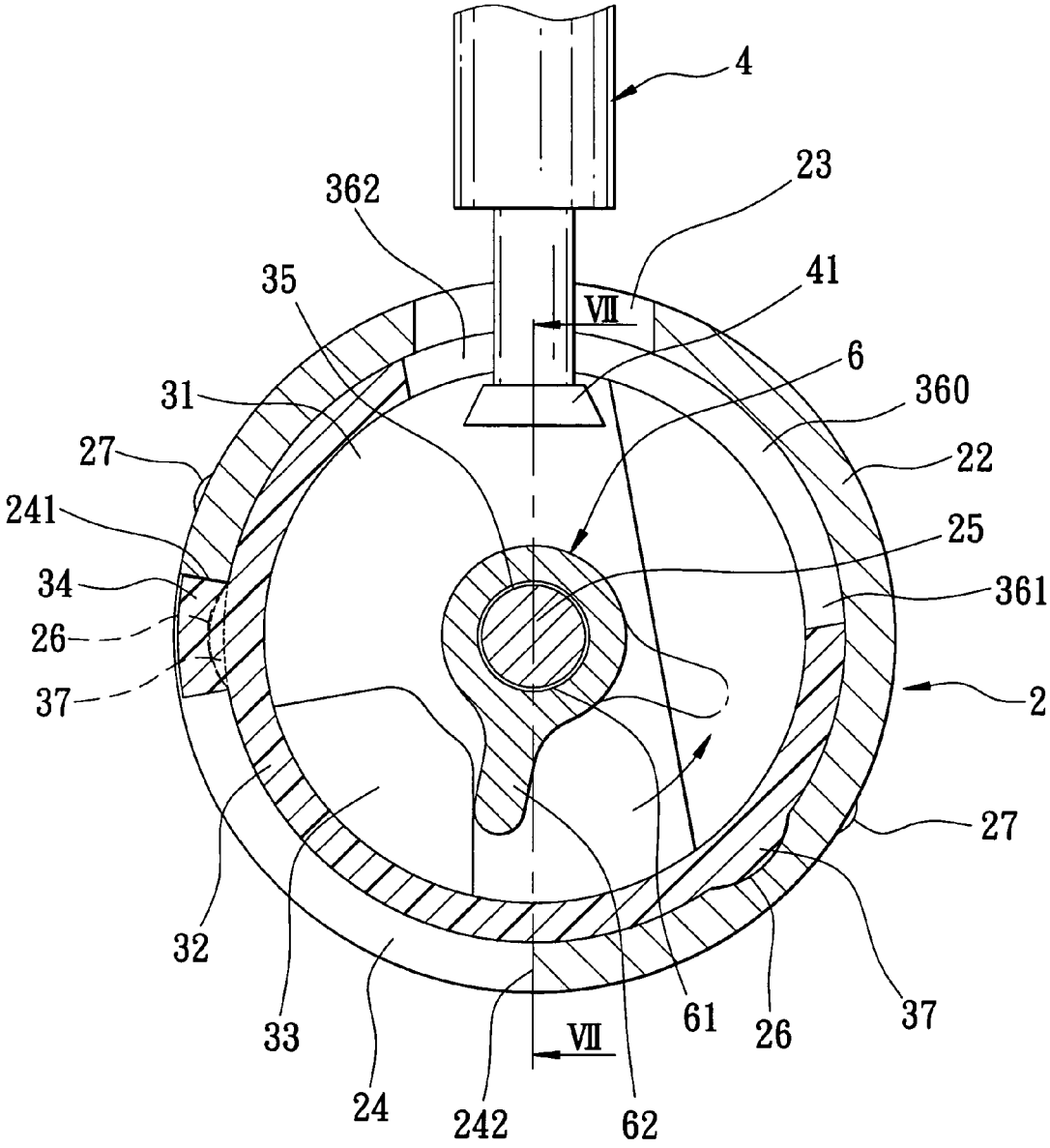
FIG. 6 is a sectional view of the preferred embodiment in the direction transverse to the core axis, illustrating the lock core in an unlocking position.

The inserting segment 362 is aligned with the insert hole 23 in the surrounding shell wall 22 when the lock core 3 is in the unlocking position to permit the locking shaft 4 to extend into and to be removed from the engagement slot 360, as best shown in FIG. 6. The engaging segment 361 is aligned with the insert hole 23 when the lock core 3 is in the locking position, such that the restricted neck portion 42 of the locking shaft 4 is disposed in the engaging segment 361 to prevent the locking shaft 4 from disengaging from the engagement slot 360, as best shown in FIG. 4.

The face plate 5 is secured on the outer surface 111 of the surrounding box wall 110 to span the lock-receiving space 112, and is formed with a key hole 51 for access to the key compartment 31 of the lock core 3.

The key 6 is inserted removably into the key compartment 31 through the key hole 51 in the face plate 5, and is operable so as to drive rotation of the lock core 3 about the core axis (X) between the locking and unlocking positions. The key 6 is formed with a blind hole 61 for sleeving engagement with the guide shaft 25 when the key 6 is inserted into the key compartment 31. The key 6 further has an actuating part 62 that can abut against the driven projection 33 of the lock core 3 to enable the key 6 to drive rotation of the lock core 3 between the locking and unlocking positions when the key 6 is inserted into the key compartment 31.

As shown in FIG. 1, FIG. 3, FIG. 6, and FIG. 7, when the lock device is installed in the box 1, the lock core 3 is initially in the unlocking position. To conceal the box compartment 116, the lid portion 12 is operated to cover the box opening 117 of the body portion 11 such that the locking shaft 4 extends successively through the extension hole 114 in the body portion 11, the insert hole 23 in the surrounding shell wall 22, and the inserting segment 362 of the engagement slot 360 in the surrounding core wall 32. Then, the key 6 is inserted into the key compartment 31 through the key hole 51 in the face plate 5 such that the blind hole 61 is sleeved on the guide shaft 25 of the lock shell 2, and such that the actuating part 62 abuts against the driven projection 33 of the lock core 3.

Figure 5:
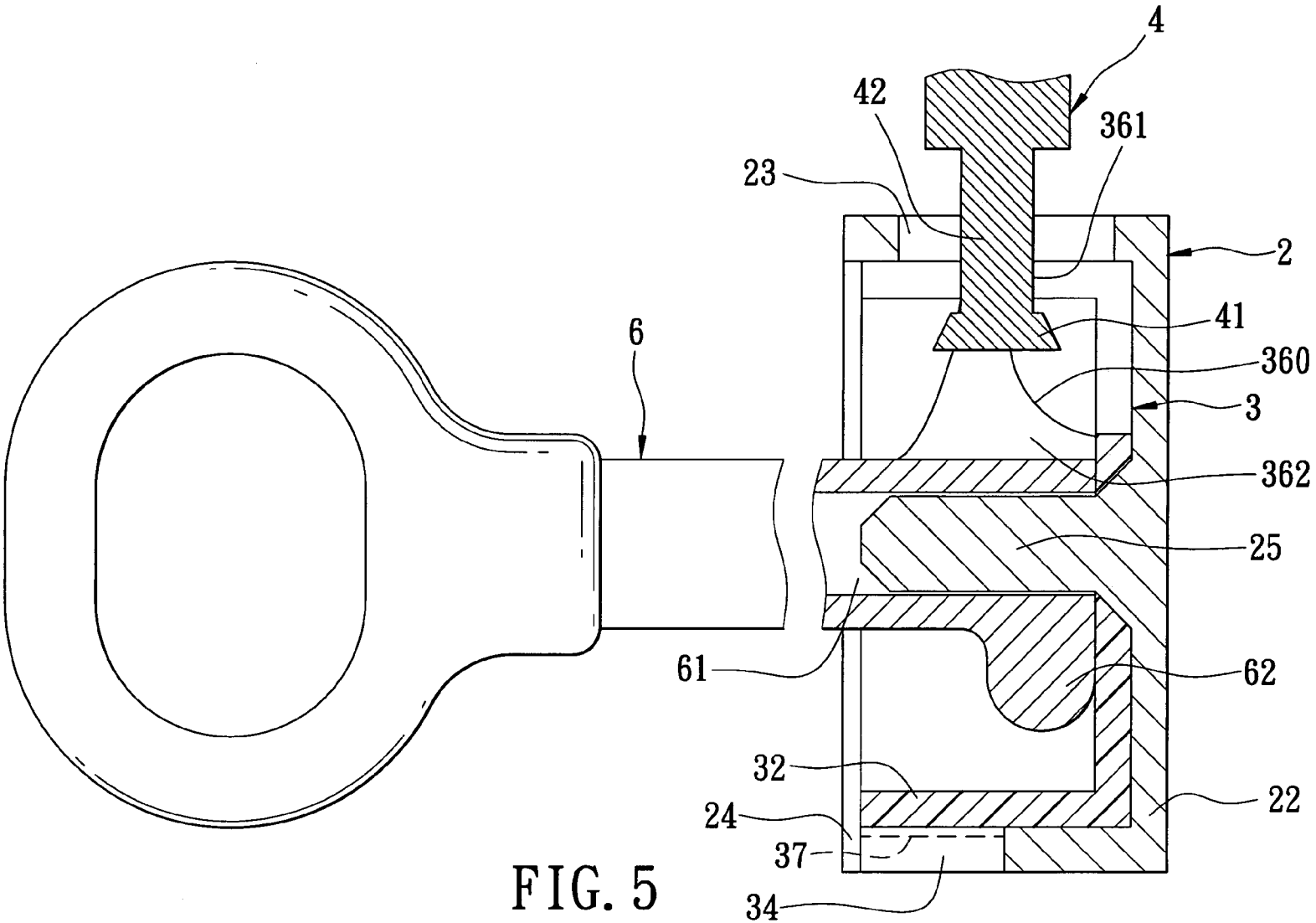
FIG. 5 is a sectional view of the preferred embodiment taken along line V—V in FIG. 4, illustrating the lock core in the locking position.

In order to move the lock core 3 from the unlocking position to the locking position, the key 6 is rotated in a counterclockwise direction such that the driven projection 33 is urged by the actuating part 62 to rotate the lock core 3 about the guide shaft 25 until the stop block 34 of the lock core 3 is blocked by the second notch edge 242 of the notch 24 in the surrounding shell wall 22, as best shown in FIGS. 4 and 5. At this time, the engaging segment 361 of the engagement slot 360 is aligned with the insert hole 23 in the surrounding shell wall 22, while the restricted neck portion 42 of the locking shaft 4 is disposed in the engaging segment 361 to prevent the locking shaft 4 from disengaging from the engagement slot 360, such that the lock core 3 is in the locking position. It should be noted herein that, due to the configuration of the driven projection 33 in this embodiment, the key 6 is rotated in the counterclockwise direction for approximately 300 degrees before the actuating part 62 can urge the driven projection 33 for moving the lock core 3 from the unlocking position to the locking position.

Figure 3:
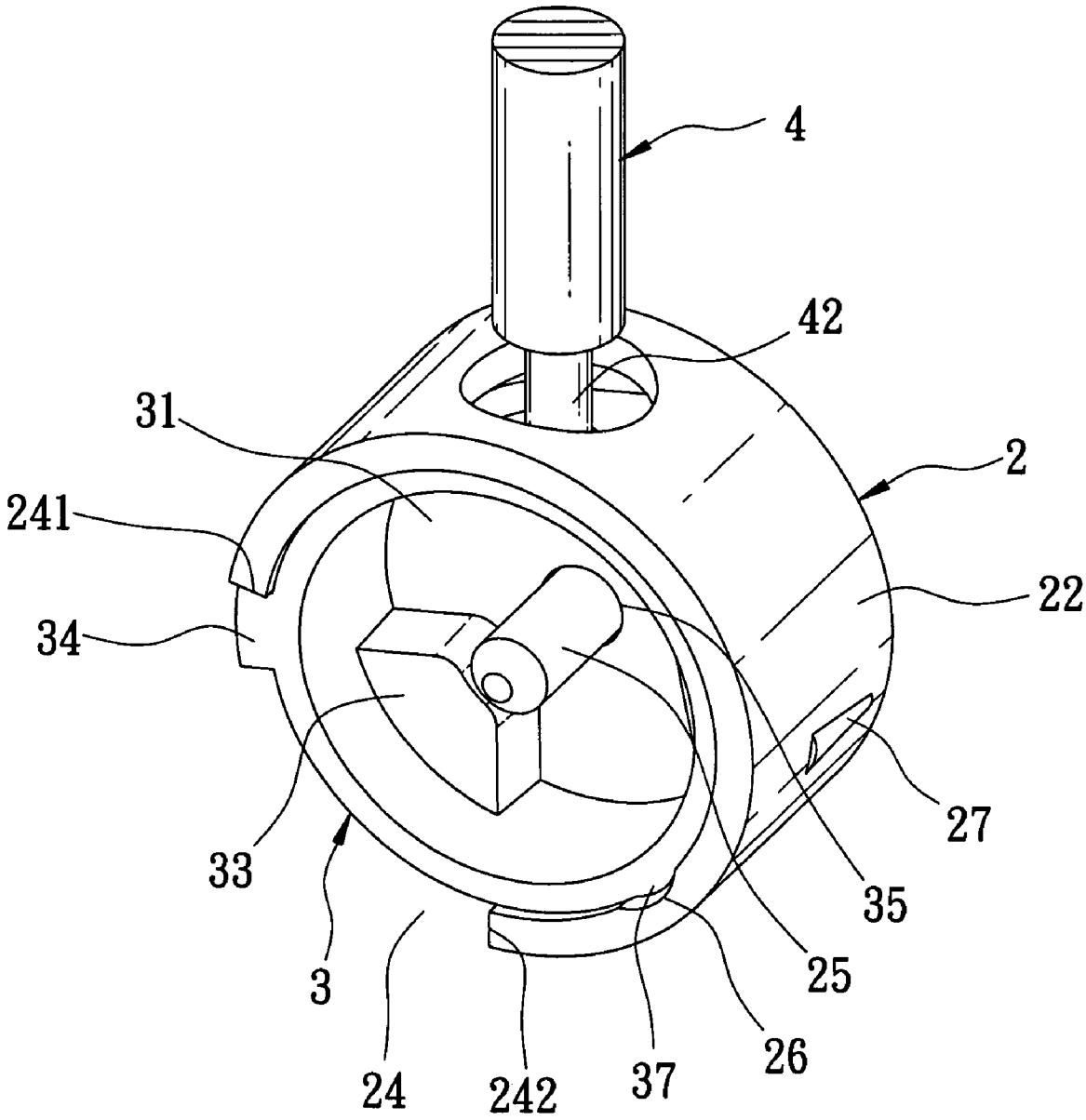
FIG. 3 is a fragmentary assembled perspective view of the preferred embodiment.
Figure 7:
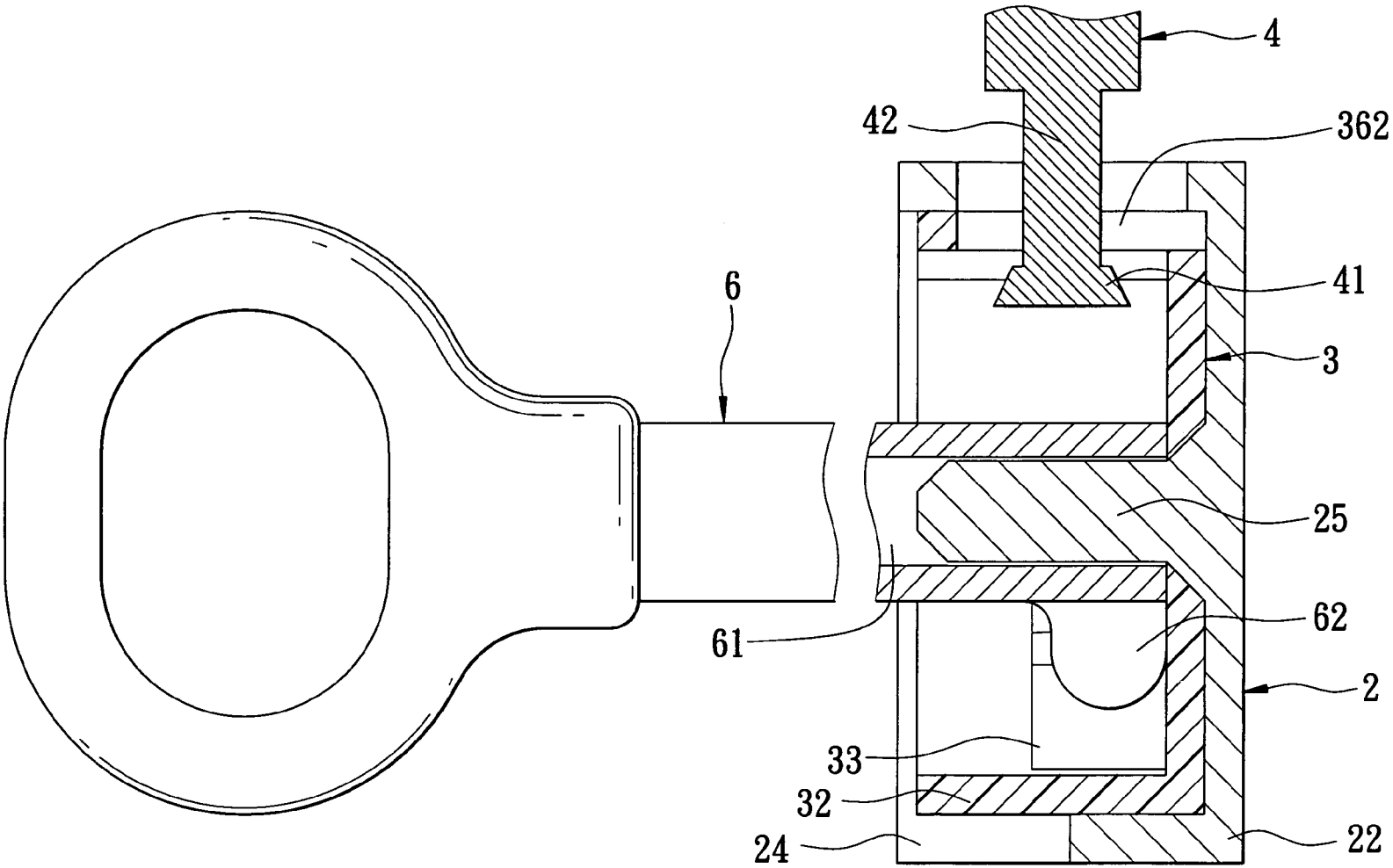
FIG. 7 is a sectional view of the preferred embodiment taken along line VII—VII in FIG. 6, illustrating the lock core in the unlocking position.

As shown in FIG. 3, FIG. 4, and FIG. 5, on the other hand, to move the lock core 3 from the locking position to the unlocking position, the key 6 is first inserted into the key compartment 31 through the key hole 51 in the face plate 5, such that the blind hole 61 is sleeved on the guide shaft 25, and such that the actuating part 62 abuts against the driven projection 33. Then, the key 6 is rotated in a clockwise direction such that the driven projection 33 is urged by the actuating part 62 to rotate the lock core 3 about the guide shaft 25 until the stop block 34 of the lock core 3 is blocked by the first notch edge 241 of the notch 24 in the surrounding shell wall 22 as best shown in FIGS. 6 and 7. At this time, the inserting segment 362 of the engagement slot 360 is once again aligned with the insert hole 23 in the surrounding shell wall 22 to permit insertion and removal of the locking shaft 4 into and out of the insert hole 23. Simultaneously, the resilient bumps 37 of the lock core 3 engage the pits 26 in the surrounding shell wall 22 such that the lock core 3 is prevented from rotating in the lock shell 3 due to external disturbance/vibrations. According to FIG. 1, FIG. 6, and FIG. 7, since the insertion segment 362 of the engagement slot 360 is larger than the enlarged head portion 41 of the locking shaft 4, the lid portion 12 of the box 1 can be lifted from the body portion 11 such that the locking shaft 4 is removed from the key compartment 31. It should be noted herein that, due to the configuration of the driven projection 33 in this embodiment, the key 6 is rotated in the clockwise direction for approximately 300 degrees before the actuating part 62 can urge the driven projection 33 for moving the lock core 3 from the locking position to the unlocking position.

Therefore, the lock device for a box according to the present invention has the following advantages:

1. Unlike conventional lock devices, the lock device according to the present invention can be applied to boxes with thin walls due to its simple structure.
2. Application of the lock device to a box is simplified in that the box 1 now requires drilling instead of milling to create the lock-receiving space 112 for installing the lock device therein. Therefore, the cost is accordingly decreased to make the lock device more market competitive.
3. With the presence of the pits 26, the resilient bumps 37, and the shaft engaging unit 36, the lock core 3 can be secured in both the locking and unlocking positions, thereby ensuring that the operation of the lock device is convenient and practical.

While the present invention has been described in connection with what is considered the most practical and preferred embodiment. It is understood that this invention is not limited to the disclosed embodiment but is intended to cover various arrangements included within the spirit and scope of the broadest interpretation and equivalent arrangements.

What is claimed is:

1. A lock device for a box, said lock device comprising:

a locking shaft;

a lock shell having a surrounding shell wall that surrounds a core axis and that confines a core-receiving space, said surrounding shell wall being formed with an insert hole that is disposed radially relative to the core axis, that is in spatial communication with said core-receiving space, and that permits removable extension of said locking shaft into said core-receiving space;

a lock core disposed movably in said core-receiving space and having a surrounding core wall that surrounds the core axis, that confines a key compartment, and that is formed with a shaft engaging unit, said lock core being rotatable about the core axis in said lock shell between a locking position where said shaft engaging unit engages said locking shaft that is extended through said insert hole, and an unlocking position where said shaft engaging unit is disengaged from said locking shaft;

a limiting unit for limiting rotation of said lock core in said lock shell; and a key inserted removably into said key compartment and operable so as to drive rotation of said lock core about the core axis between the locking and unlocking positions;

wherein said surrounding core wall is formed with a driven projection that extends into said key compartment, said key having an actuating part inserted removably into said key compartment and operable to abut against said driven projection to enable said key to drive rotation of said lock core between the locking and unlocking positions; and wherein, when said key is inserted into said key compartment to move said lock core between the locking and unlocking positions, said key is rotatable idly in said key compartment before said actuating part can abut against and urge said driven projection for moving said lock core between the locking and unlocking positions;

said locking shaft has a restricted neck portion and an enlarged head portion connected to said restricted neck portion and having a cross-section larger than that of said restricted neck portion;

said shaft engaging unit includes an engagement slot that is formed in said surrounding core wall, that extends in a circumferential direction relative to the core axis, that is aligned with said insert hole in a radial direction relative to the core axis, and that is in spatial communication with said key compartment;

said engagement slot having an inserting segment and an engaging segment in spatial communication with said inserting segment;

said inserting segment being larger than said enlarged head portion of said locking shaft and being aligned with said insert hole in said surrounding shell wall when said lock core is in the unlocking position to permit said locking shaft to extend into and to be removed from said engagement slot; and said engaging segment being smaller than said enlarged head portion of said locking shaft, being larger than said restricted neck section, and being aligned with said insert hole in said surrounding shell wall when said lock core is in the locking position, said restricted neck portion of said locking shaft being disposed in said engaging segment when said lock core is in the locking position to prevent said locking shaft from disengaging from said engagement slot.

2. The lock device for a box as claimed in claim 1, wherein said limiting unit includes:

a notch formed in said surrounding shell wall and extending in a circumferential direction relative to the core axis; and a stop block formed on said surrounding core wall and extending into said notch in said surrounding shell wall.

3. The lock device for a box as claimed in claim 1, wherein said engagement slot has a slot width that gradually increases from said engaging segment to said inserting segment.

4. The lock device for a box as claimed in claim 1, wherein:

said lock shell further has a guide shaft that extends into said key compartment along the core axis, said key being formed with a blind hole for sleeving engagement with said guide shaft when said key is inserted into said key compartment.

5. The lock device for a box as claimed in claim 1, wherein said surrounding shell wall has an inner wall surface formed with a pit, and said surrounding core wall has an outer wall surface formed with a resilient positioning bump that engages said pit when said lock core is in the unlocking position.

6. The lock device for a box as claimed in claim 1, wherein said surrounding shell wall has an outer wall surface formed with at least two wedges that project therefrom.

7. The lock device for a box as claimed in claim 6, wherein each of said wedges has a thickness that gradually increases in a direction parallel to the core axis.

* * * * *